United States Patent [19]

Stelling

[11] 3,989,337

[45] Nov. 2, 1976

[54] INTERLOCKING CONNECTOR

[75] Inventor: Richard P. Stelling, Norwalk, Conn.

[73] Assignee: Burndy Corporation, Norwalk, Conn.

[22] Filed: Jan. 2, 1976

[21] Appl. No.: 646,222

[52] U.S. Cl. ..... 339/90 R; 339/188 C

[51] Int. Cl.[2] ..... H01R 23/60

[58] Field of Search ..... 339/90 R, 90 C, 88 R, 339/188 R, 188 C; 285/358, 360, 361, 376, 377, 396, 401, 402; 403/348, 349, 378

[56] References Cited

UNITED STATES PATENTS

| | | | |
|---|---|---|---|
| 2,093,037 | 9/1937 | Douglas | 339/188 C X |
| 2,302,276 | 11/1942 | Violet | 339/188 C |
| 3,116,942 | 1/1964 | Morello | 339/90 R X |
| 3,824,681 | 7/1974 | Clark | 339/90 C X |

*Primary Examiner*—Granville Y. Custer, Jr.
*Assistant Examiner*—E. F. Desmond
*Attorney, Agent, or Firm*—Howard S. Reiter

[57] ABSTRACT

This invention relates to circular or cylindrical connectors comprising a male and a female member which are brought together to effect electrical interconnection between circuit components with subsequent locking of the members together by rotation of collar which is rotatably affixed to one of the members and has internal spiral grooves which engage pins affixed to the other of the connector members. In one embodiment the collar and pins are made from metal, and the pin-bearing member is made from plastic, and the torque-break resistance of the connector is improved through the use of L-shaped anchor strips to which the pins are affixed.

10 Claims, 1 Drawing Figure

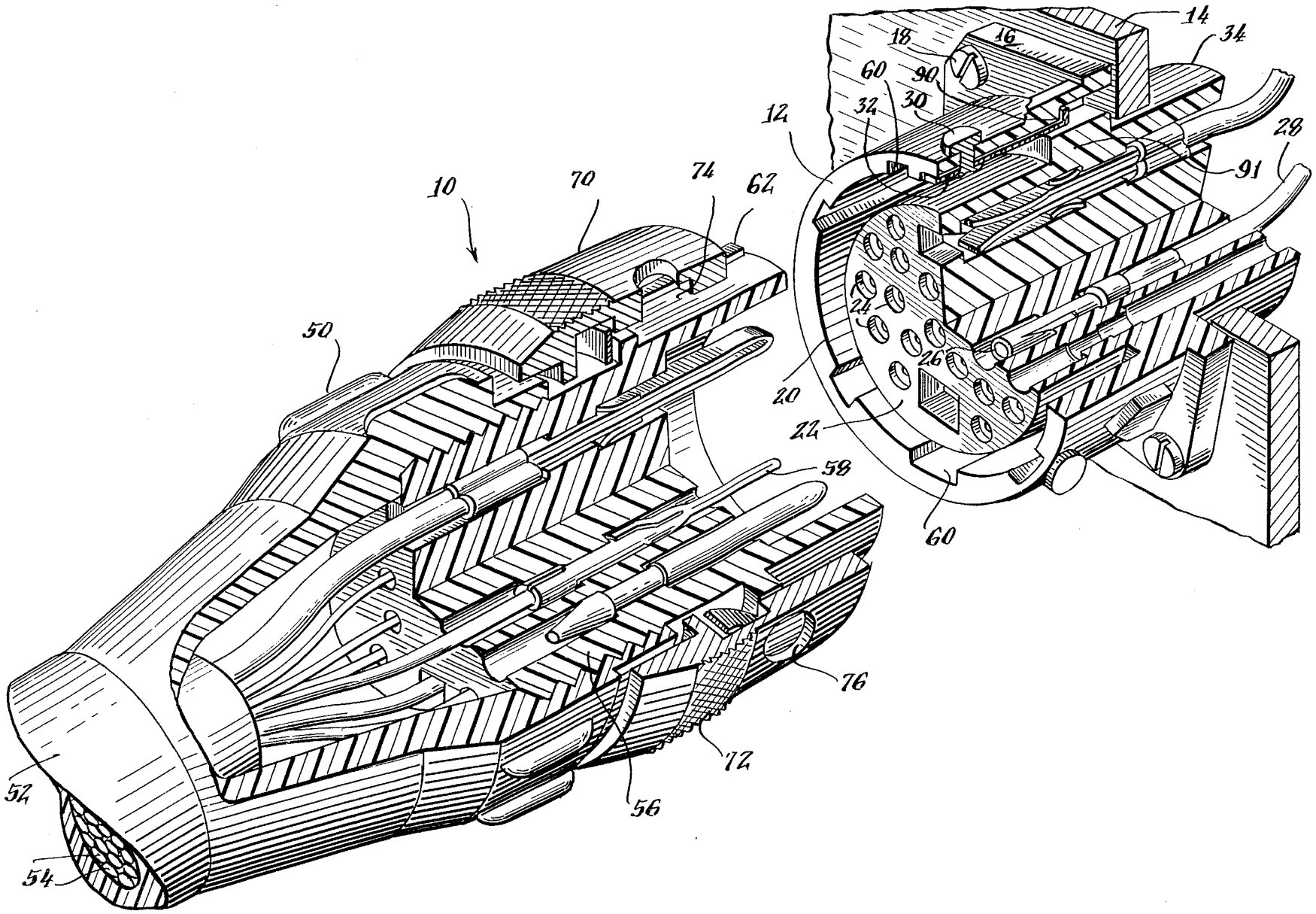
14
34
28
91
16
18
90
30
60
32
12
62
74
70
10
50
20
24
26
22
60
58
76
72
56
54
52

INTERLOCKING CONNECTOR

BACKGROUND OF THE INVENTION

In the field of electrical connectors, frequently it is desired to interconnect a grouping of electrical contacts by means of removable connector devices. Thus, for example, it is known to make electrical connectors for use in military electronics applications wherein a round bundle of cables is terminated in a terminal having a number of electrical contacts arrayed in a configuration corresponding to that of an associated connector terminal member to which the cable terminal is to be removably affixed. In this fashion, one or the other of the terminal members may contain male electrical connectors for insertion into corresponding female connector members in the other of the connector terminal members. Thus the two members comprising the connector may be brought together, their respective electrical contact members interengaged, and they may then be held together by appropriate associated mechanical means. One known method of effecting such mechanical interconnection is by means of an outer ring-like collar positioned about the outside of one of the connector terminal members, which collar is rotatable with respect to its associated connector member. The inside of the collar may have an internal helical groove into which pins integral with the outside of the other of the connector terminal members may be positioned. Thereafter, upon the collar being rotated, the helical grooves migrating along the pins will cause the two connector terminal members to be brought together into intimate and selectively permanent juxtaposition.

In the past it has been found that among such connectors, those which exhibit the greatest ability to resist being torn apart are ones made completely from metal. However the difficulties experienced in manufacturing such structures made entirely from metal, as well as their cost, weight and physical characteristics (e.g. tendency towards corroding and/or fusing to each other), has presented some problems for which alternatives have been sought utilizing other constituent materials. Thus, for example, it has been proposed to make such connectors entirely from plastic material. However it has been found that such all-plastic connectors exhibit relatively poor resistance to being broken apart upon the pin-helical groove portion of the structure being subjected to substantial forces. Alternative measures which have been sought to circumvent this drawback include making the groove-pin portions of metal and the rest of the connector from plastic or other suitable material, but such structures have not proven to exhibit as high resistance to breaking apart as desired, since such resistance then becomes dependent primarily upon the integrity of the bond between the metal and the plastic. Alternative remedies which have been sought include merely embedding metal pins in plastic and/or backing them with backing plates to prevent their tearing out when torque stresses are placed upon the connections.

Accordingly an object of the present invention is to provide means whereby circular electrical connectors may be made relatively easily and inexpensively and preferably in large part from plastic materials, which will exhibit satisfactory resistance to breaking apart through the application of torque forces.

SUMMARY OF THE INVENTION

Desired objectives may be achieved through practice of the present invention which, in one embodiment, comprises a circular connector having the connector terminal bodies made from plastic with a rotatable metal collar positioned to one of the connectors and with metal engaging pins positioned on the other of the connectors, which pins are backed by axially aligned L-shaped anchor members.

DESCRIPTION OF THE DRAWINGS

This invention may be clearly understood from the description which follows and from FIG. 1 which illustrates a preferred embodiment of this invention.

DESCRIPTION OF PREFERRED EMBODIMENTS

Referring to FIG. 1, there is depicted a circular electrical connector 10 comprising a female receptacle body 12 which may be affixed to a panel 14 or other electrical apparatus by means such as a base portion 16 and associated screws 18 or other known per se attaching means which extend through the base 16 and the panel 14. The receptacle 12 comprises a plastic outer shell 20 integrally molded with an inner receptacle plate 22 having a multiplicity of female receptacle members 24, each of which may contain a female electrical connector socket 26 which is mechanically and electrically interconnected with an associated conductor 28. For purposes of effecting the coupling hereinafter described, the outer shell 20 of the female member 12 includes coupling pins 30 which extend through the outer shell 20. In this embodiment, the coupling pins are supported on the inside of the shell by means of anchor strips 32 which are elongated strips made from metal or other suitable material positioned with their long axes oriented more or less parallel to the axis of the connector, and having an L-shaped innermost end 34. For reasons which will be apparent, it is desired that such coupling strips or pins 32 be made from a metal or other material which is relatively resistant to straightening out after having been formed as hereinafter described. It will also be apparent from the explanation which follows, that although, as shown, the L-shaped portions of the strip bends outward, away-from the axis of the terminal members with which it is associated, it might also advantageously be designed to bend inward, or even to one side or the other; in any of which events, of course, a backing shoulder such as that shown in FIG. 1 as item 91, the purpose of which is discussed hereinafter, may advantageously be repositioned adjacent the main body of the strip at the side thereof opposite that from which said L-shaped portion extends.

The connector 10 has an associated male coupling member 50 affixed to a cable 52 having a multiplicity of conductors 54 therein. The individual conductors are arrayed in a desired configuration within the main body 56 of the connector member 50 and are electrically and mechanically interconnected with male contact members 58 which correspond in dimension and location to the female receptacles 24 when the connector members 12, 50 are properly aligned as governed by appropriate slot 60 and key 62 components included with the receptacle members. There is positioned about the outside of the receptacle member 50 a circular collar member 70 which is rotatable with respect to the receptacle member 50. For reasons which will be apparent, this collar member may be made from any of a number of strong materials, such as high strength aluminum, and desirably has a knurled portion 72 to facilitate grasping for turning. It will also be noted that the collar member 70 includes an internal helical path 74 into which the pins 30 on the other of the receptacle members may be admitted; the pins 30 and the associated helical groove 74 operating cooperatively to effect closure and retention of the two connector members 12, 50 to each other. It should also be noted that advantageously holes 76 may be drilled through the collar to provide pin seats (not shown) in the internal helical tracks positioned at substantially the same angular disposition with respect to the collar 70 as are the pins 30 with respect to the receptacle 12, so as to provide a means whereby the collar may be locked in a retained position once interconnection of the connector components has finally occurred through each of the pins 30 seating themselves within a lateral deviation in the wall of a helical groove which has been provided by the hole 76.

It will be apparent from FIG. 1 that when the two constituent members of a circular connector of the type illustrated are in the fully engaged position, one of the critical measures of the integrity of the connection is the ability of the completed connector to withstand torque moments of force; i.e. bending moments applied normal to the axis of the connector. For example, it will be apparent that if a connector positioned on the cable 52 were to have some sudden downward force applied to it, there would be a tendency for the pins 30 held within the groove 14 of the member 50 to tear out of the shell 20 of the connector member 12, thereby breaking the connector apart and destroying the integrity of the electrical interconnection. It should be noted, however, that by practice of the present invention, for example through embodiments of the type shown in FIG. 1, any such motion is effectively translated into the ability of the L-shaped portion 34 of the anchor strip 32 to resist becoming unbent, since the L-shaped portion 32 may be sufficiently imbedded within the structure of the connector member 12 (for example as deep as within the base 16), to provide enough material to ensure against it being merely ripped out. In fact, to some extent at least, such forward motion on the coupling strip induced by the application of a torque moment to the connector as a whole is translated into compression of the constituent material, at least in the region immediately adjacent to and within the angle of the L-shaped portion. It should also be noted that there may be some tendency for the L-shaped portion of the coupling strip in resisting unbending, to move downward so that the L-shaped portion 34 might merely pass by the lip 90 with which it has formerly been associated. However, this may be effectively inhibited by forming the connector member 12 in such a fashion that there is a shoulder 91 positioned beneath the L-shaped portion 34 and for a substantial enough distance along the length of the coupling strip 32, to support the coupling strip against the L-shaped portion moving out from under the lip 90, thus ensuring that any tension placed on the coupling strip 32 must be translated into an amount of work necessary to unbend the L-shaped portion 34.

It is common procedure in working with electrical connectors of the type herein described to perform certain tests which are designed to measure the ability of the connector to maintain its integrity under the application of such torque moments. Thus for example a "External Bending Moment Test" forms part of U.S. Military Specification MIL-C-0038999, Revision E, Paragraph 4.7.15. Utilizing the procedure prescribed by this test requirement, test work was performed on certain representative samples of circular connectors to determine the effect of various pin and collar constructions insofar as the ability of the connector to withstand being torn apart. Samples used were as follows:

Sample number was a standard all-metal, smooth, circular connector;

sample number 2 was an all-plastic circular connector;

sample number 3 was a circular connector in which one terminal element had a plastic shell with an outer metal collar and the other terminal element had plastic pins merely embedded in the associated shell;

sample number 4 was a circular connector with one plastic terminal element having a metal collar ring and with the other terminal element having a plastic shell with metal pins inserted into the plastic and through a short metal backup plate;

sample number 5 was a circular connector with one plastic terminal element with a metal collar, and with the other terminal element having a plastic shell to which was affixed a metal ring having metal pins mounted thereon;

sample number 6 was a circular connector with one plastic terminal element having a metal collar ring and with the other terminal element having a plastic shell with L-shaped coupling pins of the type hereinbefore described but without a shoulder (such as that shown as item 91 in FIG. 1) to resist deflection of the L-shaped portion.

Samples number 2 and number 5 were size 18, and all others were size 24. When tested according to the aforementioned MIL-C External Bending Moment Test, the samples indicated the following values:

Sample 1 — 650 inch/pounds
Sample 2 — 70 inch/pounds
Sample 3 — 120 inch/pounds
Sample 4 — 130 inch/pounds
Sample 5 — 90 inch/pounds
Sample 6 — 300 inch/pounds.

It will be clear that had a backing shoulder, like item 91 in FIG. 1, been included in the construction of a connector like Sample 6, the test would have exhibited even higher inches than did Sample 6, since the L-shaped portion of the coupling pin in Sample 6 was observed after the test to have slid past its associated lip without having unbent significantly.

It is to be understood that the embodiment of this invention herein described and shown is by way of illustration but not of limitation and that other embodiments of the present invention may be made without departing from the spirit or scope of this invention.

I claim:

1. The circular electrical connector of the type wherein one of a pair of inter-engaging members has a revolvable circular outer collar having at least one interior helical groove attached for cooperative inter-engagement with pins affixed to the shell portion of the other of said pair of members to effect removable affixation of said members to each other, comprising at least one elongating backing strip affixed to and positioned interiorly of said shell portion with at least one of said pins affixed to a main portion of said strip, said strip extending inwardly of said shell from the point of affixation to said strip of said pin, the long axis of said strip being substantially parallel to the axis of the member to which it is affixed, said backing strip being L-shaped at a portion thereof inwardly of said shell portion from said point of affixation.

2. The device described in claim 1 wherein said L-shaped portion is formed at the end of said strip.

3. The device described in claim 1 wherein said L-shaped portion extends from the main portion of said strip in a direction away from the axis of the member with which it is associated.

4. The device described in claim 3 wherein said L-shaped portion extends from the main portion of said strip in a direction which is normal to the axis of the member with which it is associated.

5. The device described in claim 1 wherein the member with which said strip is associated includes a backing shoulder positioned adjacent the main portion of said strip at the side thereof opposite that direction towards which said L-shaped portion of said strip extends.

6. The device described in claim 2 wherein the member with which said strip is associated includes a backing shoulder positioned adjacent the main portion of said strip at the side thereof opposite that direction towards which said L-shaped portion of said strip extends.

7. The device described in claim 3 wherein the member with which said strip is associated includes a backing shoulder positioned adjacent the main portion of said strip at the side thereof opposite that direction towards which said L-shaped portion of said strip extends.

8. The device described in claim 4 wherein the member with which said strip is associated includes a backing shoulder positioned adjacent the main portion of said strip at the side thereof opposite that direction towards which said L-shaped portion of said strip extends.

9. The device described in claim 1 comprising a multiplicity of backing strips and associated pins.

10. The device described in claim 8 comprising a multiplicity of backing strips and associated pins.

* * * * *